United States Patent [19]

Sasson

[11] 4,015,351

[45] Apr. 5, 1977

[54] PERPETUAL CALENDAR

[76] Inventor: Eli Sasson, 605 N. Bedford, Beverly Hills, Calif. 90210

[22] Filed: Feb. 23, 1976

[21] Appl. No.: 660,340

[52] U.S. Cl. ..... 40/110; 40/65

[51] Int. Cl.[2] ..... G09D 3/00

[58] Field of Search ..... 40/110, 109, 107, 65, 40/64 R, 17, 118

[56] References Cited

UNITED STATES PATENTS

| | | | |
|---|---|---|---|
| 2,871,595 | 2/1959 | Pearce | 40/110 |
| 3,402,694 | 9/1968 | Christman | 40/65 X |
| 3,596,390 | 8/1971 | Scalice | 40/65 |
| 3,827,168 | 8/1974 | Mori | 40/110 |

*Primary Examiner*—John F. Pitrelli
*Attorney, Agent, or Firm*—Huebner & Worrel

[57] ABSTRACT

A perpetual calendar operated by finger pressure wherein there is a base portion formed with horizontal grooves and including an overlay covering said base, the overlay has horizontal rows of etched transparent indicia. A plurality of slidable color plates are appropriately mounted in said grooves and when moved under said etched transparent indicia, visual registration of the specific transparent indicia is accomplished. The invention also includes color plate propelling means associated with the color plates extending exteriorly of said base and overlay for finger movement to slide the color plates into appropriate registry.

1 Claim, 9 Drawing Figures

PERPETUAL CALENDAR

BACKGROUND OF THE INVENTION

Various perpetual calendars have been developed in the past. However, those of which applicant is aware are of the type that require the use of magnetic material to either accomplish the movement of plates to register with calendar indicia or include magnetic rings that are physically moved on the surface of the calendar to surround a particular day.

In any of the foregoing type the inclusion of magnetic material usually greatly increases the cost of the calendar because of the cost of the material as well as the additional labor to inserting the magnetic material.

Further, with some magnetic calendars there are separate magnets such as bars or horseshoe magnets which are not attached to the calendar and if lost or misplaced render the calendar inoperative until replaced.

SUMMARY OF THE INVENTION

The present invention is directed to a perpetual calendar which is completely self-contained requiring no additional elements to move appropriate parts thereof for registry and viewing.

The calendar of this invention includes a base member having a plurality of parallel grooves and an overlay covering the base. Mounted within the grooves are color plates that are slidable or movable therein.

The overlay has etched indicia therein which renders the overlay at the point of the indicia transparent. The color plates may then be moved in the grooves to come into registry with a particular transparent indicia for viewing.

The color plates include propelling means associated therewith and each has a part exterior of the base or overlay for finger touch to effect movement of the plates.

With the combination of parts and preferred molding thereof there is produced a perpetual calendar which is relatively inexpensive, simple to operate and visually pleasing.

These and other objects and advantages will become apparent from the following description and drawings, wherein:

DETAILED DESCRIPTION OF THE PREFERRED EMBODIMENTS

Figure 1:
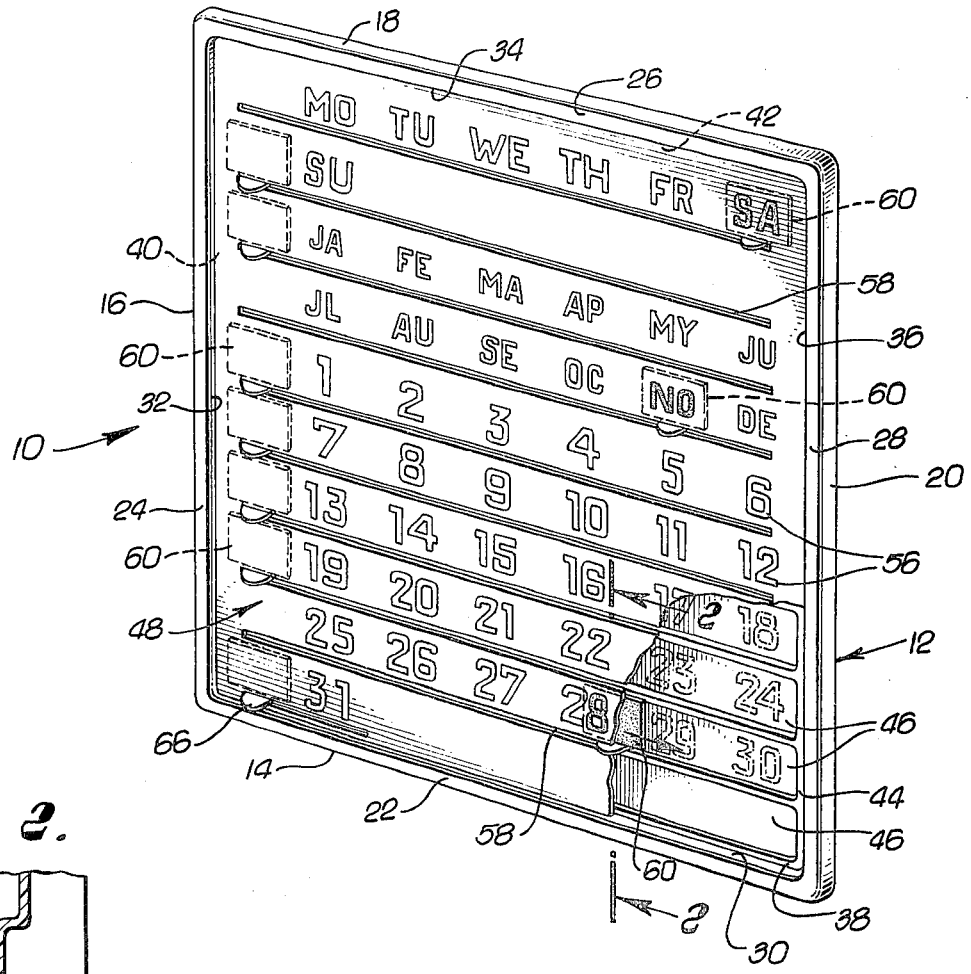
FIG. 1 is a perspective view of the perpetual calendar of this invention partly in cutaway.

In FIG. 1 the basic embodiment of a perpetual calendar generally designated 10 is illustrated. Preferably, the calendar 10 includes a base member designated 12 which can be molded of plastic or formed of other material.

The base member 12 is preferably peripherally, rectangularly shaped as best seen in FIG. 1. When the base member 12 is molded of a single piece of plastic it includes marginal edges 14, 16, 18 and 20. Each edge is turneKBskb:!ges 38, 40, 42 and 44 which are parallel with the front frame surfaces 22, 24, 26 and 28.

At this point in the molded construction a series of grooves or recesses 46 are provided within the base member 12 that run between the flanges 40 and 44 in a horizontal direction. The grooves 46 are spaced apart and correspond in number to rows of indicia to be described.

Figure 2:
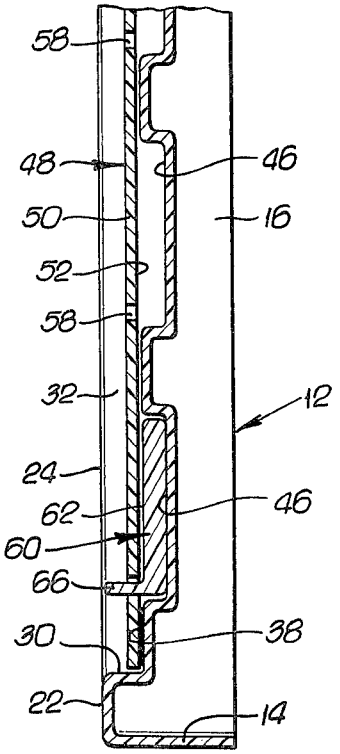
FIG. 2 is a enlarged cross sectional view of the interior of the calendar taken on lines 2—2 of FIG. 1.

As further illustrated in FIGS. 1 and 2, there is next provided an overlay generally designated 48, which is preferably a sheet of transparent plastic 50 which is coated on the reverse or inner side 52 with a masking paint 54. The masking paint 54 is etched at various areas to form indicia 56 in the form of letters and numbers which in the particular embodiment illustrated in the invention, includes abbreviations for months, days and numerical days of a month. As can be seen from the drawings, the indicia 56 is etched in horizontal rows corresponding with the number of grooves 46 formed in the base 12. Thus, the etched indicia which creates a transparency is aligned with the respective grooves 46 and overlies the same.

The sheet material 50 is preferably cut to the interior dimension of the base 12 and as best seen in FIG. 2, is secured by any appropriate adhesive means to the flanges 38, 40, 42 and 44.

Additionally, the transparent sheet 50 as viewed in FIGS. 1 and 2, includes a plurality of horizontal slots 58 cut through the sheet 50. These slots are preferably oriented so that they overlie the bottom portion or lower portion of the respective grooves or recesses 46. As can be seen from FIG. 1, the slots 58 have ends which are spaced inwardly of the marginal ribs 32 and 34.

In view of the fact that the overlay 48 has a masking paint 54 thereon and the overlay is sealed to the base 12, even though the indicia 58 is etched and is transparent, generally the specific indicia is not readable until some form of backing appears between the groove and the transparent indicia 56 to highlight the same. In order to accomplish this, there is provided a movable color plate 60, best seen in FIG. 3, which can be formed from cardboard, plastic or other material. In dimension, the plate 60 is of a thickness adapted to be received between the bottom of the groove 46 and the inner side 52 of the overlay 50. The plate 60 is generally rectangular in shape and of a horizontal and vertical elevation sufficient to slightly overlap specific indicia 56. The outer face 62 of the plate 60 is provided with a distinctive color which when in registry with indicia 56, will make the same visually discernible. Thus when viewing the embodiment of FIG. 1, the plates 60 are behind the designations "SA" and "NO" and "28" so that one looking at the perpetual calendar 10 will note the date is Saturday, Nov. 28.

Figure 3:
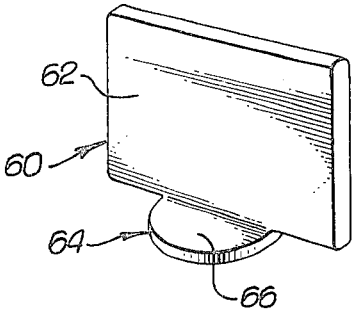
FIG. 3 is a perspective view of one of the color plates forming a part of the invention.

In order to slide or otherwise move the plate 60 there is provided propelling means 64 which in the embodiment illustrated in FIGS. 1 through 3, includes a tab 66 extending from the plate 60 normal thereto and projecting outwardly through a slot 58. As can be seen the tab 66 preferably includes a rounded edge.

In operation, with an appropriate placement of the respective rows of indicia there is created on the left side a blank area whereby plates 60 are not visible. When it is desired to select an appropriate month, day date, and day of the week, a person may with his finger move the tab 66 horizontally from left to right registering the color plate 60 with the particular day, month and date desired. In other words, with the embodiment shown in FIG. 1, three rows are utilized, namely the first row, the fourth row and the ninth row. The other color plates 60 remain at the left marginal edge of the overlay 48.

While the arrangement as shown in FIG. 1 utilizes ten rows of indicia 56, and therefore ten grooves 46, the invention is not limited to this specific arrangement. The exterior dimension of the perpetual calendar 10 can be changed so that fewer or greater numbers of rows may be created depending upon the aesthetic appearance to be created.

In addition to the indicia 56 which is eteched into the masking paint 54 of the overlay 48, various designs or illustrations may be placed on the exterior surface 68 of the overlay 48 for purposes of advertising or decorative features.

Figure 4:
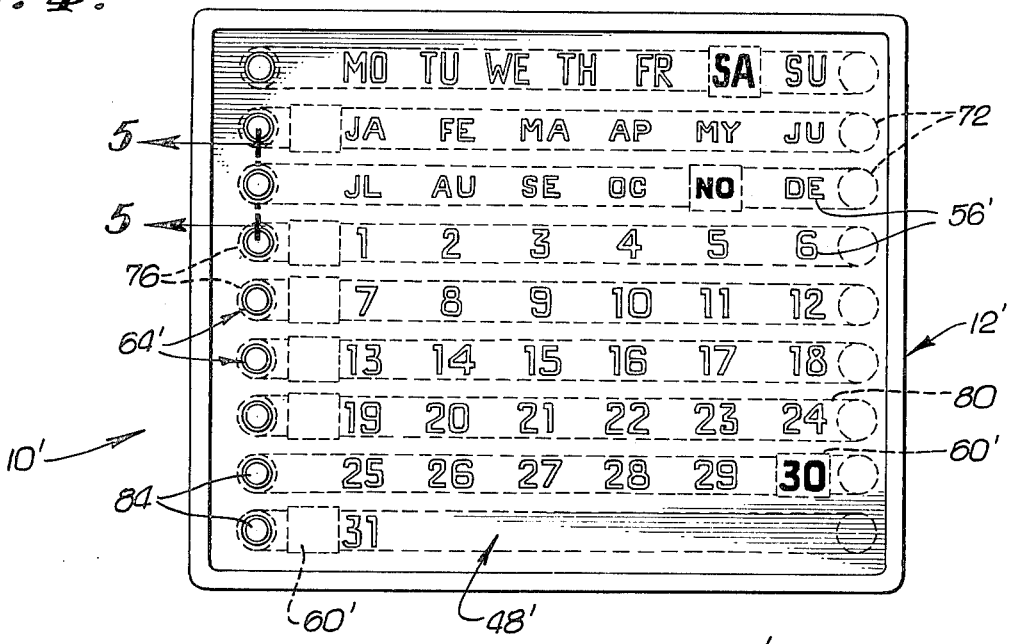
FIG. 4 is a front view of a modified form of the calendar of FIG. 1.
Figure 5:
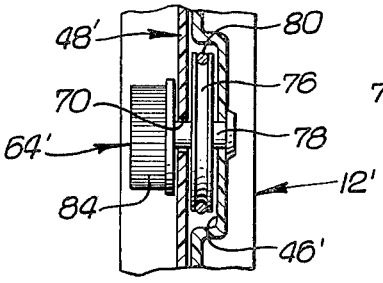
FIG. 5 is a cross sectional view of the propelling means taken on lines 5—5 of FIG. 4.

The modification of this invention which is illustrated in FIG. 4 basically includes the same perpetual calendar idea generally designated 10' including a base generally designated 12' with all of the structure previously described including grooves 46' as best seen in FIG. 5. The main point of difference with respect to the embodiment of FIG. 4 resides in the propelling means generally designated 64' for moving the color plate 60'. The overlay 48' of this embodiment does not include the horizontal slots 58 as in the first embodiment but at the left side thereof, seen in FIGS. 4 and 5, there is provided openings 70 which extend therethrough preferably centrally located between the upper and lower walls of the grooves 46'.

Figure 7:
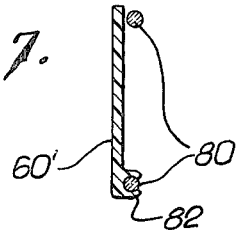
FIG. 7 is a cross sectional view of a color plate attached to the propelling means taken on lines 7—7 of FIG. 6.

The propelling means 64' for each of the grooves 46' includes a first pulley 72 mounted at the righthand marginal edge of the overlay 48' by means of a shaft 74 which is journalled through the back of the groove 46' of the base 12'. At the lefthand marginal edge of the overlay 48 there is provided a second pulley 76 which is best seen in FIG. 5. This pulley is also journalled to the base 12' by means of a shaft 78. Extending between the respective pulleys 72 and 74 is an endless belt 80 having upper and lower reaches and the belt 80 can be formed of elastic or other material. The movable color plate 60' in this particular embodiment includes a rearwardly extending clip 82 at the bottom thereof best seen in FIG. 7 which may be fixed to a reach of the belt 80.

In order to move the propelling means 64' there is included a finger knob 84 exterior of the overlay 48' which is secured to the shaft 78.

Thus, in order to move the color plate 60' within the groove 46', the knob 84 is turned which will rotate the pulley 74 and the endless belt 80 causing the color plate 60' to be moved to the desired indicia 56' etched in the overlay 48'.

Figure 6:
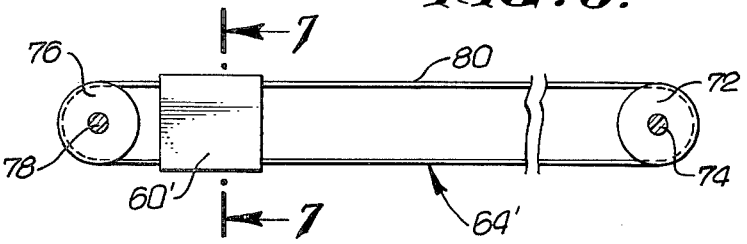
FIG. 6 is a detailed view of the propelling means and a color plate of the modification illustrated in FIG. 4.
Figure 8:
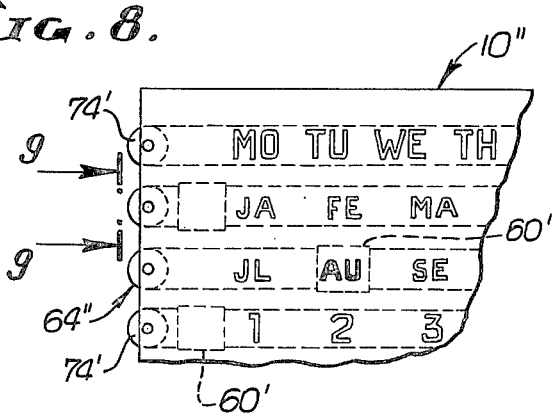
FIG. 8 is a further modification of the perpetual calendar of FIGS. 1 and 4.
Figure 9:
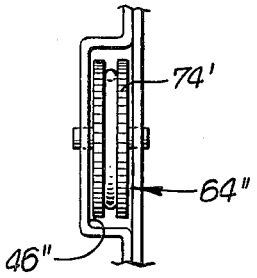
FIG. 9 is a cross sectional view of the propelling means of the modification of FIG. 8 taken on lines 8—8 of FIG. 8.

There is illustrated in FIGS. 8 and 9 of the drawings a second modification of the perpetual calendar identified as 10'' wherein the propelling means 64'' is a pulley 74' such as a pulley illustrated in FIG. 6 with the exception that it is mounted at the extreme side of the perpetual calendar 10'' so that a portion of the pulley will extend therebeyond as best seen in FIG. 8. By the use of the modifications of FIGS. 8 and 9, the knob 84 is dispensed with and the propelling means 64'' becomes the pulleys 74'.

In other words, as the pulley 74' is rotated by a finger the color plate 60' moves laterally within the groove 46'' best seen in FIG. 9 to the desired location.

While the preferred embodiment has been illustrated throughout wherein the base member 12 is of a molded single piece structure, it is to be appreciated that any form or type of material may be used to form the base portion of the invention.

In addition, the overlay 48 can be of transparent material and by silk screening processes or otherwise, the material could be covered on either side leaving a transparent portion in the form of indicia without departing from the spirit of the invention.

Although I have herein shown and described my invention in what I have conceived to be the most practical and preferred embodiment, it is recognized that departures may be made therefrom within the scope of my invention.

I claim:

1. A perpetual calendar comprising:

a base member including a marginal edge and a portion intermediate said marginal edge, and a plurality of horizontal parallel grooves formed in said portion;

an overlay of sheet material having an inner surface covering said portion of said base member capping said grooves, said overlay includes transparent indicia and said indicia is in overlying registry with said grooves of said base member and is arranged in columns and rows; and said overlay includes a plurality of horizontal slots therethrough extending between the rows of indicia with a single slot in registry with a single groove;

color plate means corresponding in number to the number of said grooves and each is seated in one of said grooves for movement therein to be in registry behind selected ones of said indicia;

propelling means associated with said color plate means each including a portion projecting from said perpetual calendar for finger engagement to move said color plate means within said grooves for said registry behind selected ones of said transparent indicia; said propelling means includes a tab projection extending generally normal to the plane of said color plate means through said slot outwardly of said calendar;

said color plate means being visible through said sheet so as to highlight said selected indicia so that visual attention is directed thereto.

* * * * *